US007634823B2

(12) United States Patent
Sisk

(10) Patent No.: US 7,634,823 B2
(45) Date of Patent: Dec. 22, 2009

(54) INTERFACE STRUCTURE FOR A SHOWER SURROUND

(75) Inventor: Thomas J. Sisk, Tottenham (CA)

(73) Assignee: Masco Corporation, Taylor, MI (US)

( * ) Notice: Subject to any disclaimer, the term of this patent is extended or adjusted under 35 U.S.C. 154(b) by 931 days.

(21) Appl. No.: 10/810,797

(22) Filed: Mar. 26, 2004

(65) Prior Publication Data

US 2005/0210577 A1 Sep. 29, 2005

(51) Int. Cl.
*A47K 3/22* (2006.01)
*A47K 3/34* (2006.01)
*A47K 3/36* (2006.01)

(52) U.S. Cl. ..... 4/614

(58) Field of Classification Search ..... 4/610, 4/612–614, 584, 596; 52/35; 403/393, 397; 277/637, 641, 640, 921; 49/43.1, 490.1, 49/492.1; 24/293–295, 297, 289
See application file for complete search history.

(56) References Cited

U.S. PATENT DOCUMENTS 4,316,295 A * 2/1982 Whitney et al. ..... 4/612
4,578,832 A 4/1986 Primucci
4,671,026 A * 6/1987 Wissinger ..... 4/614
4,817,344 A * 4/1989 Wissinger ..... 52/35
5,311,707 A * 5/1994 LaRoche et al. ..... 4/614
5,799,442 A * 9/1998 Takahashi et al. ..... 49/492.1
6,220,650 B1 * 4/2001 Davis et al. ..... 49/490.1
6,677,020 B2 * 1/2004 Dron ..... 49/490.1
6,691,339 B1 * 2/2004 Thomas ..... 4/612

FOREIGN PATENT DOCUMENTS

CA 1 157 602 11/1983

* cited by examiner

*Primary Examiner*—Tuan N Nguyen
(74) *Attorney, Agent, or Firm*—Carlson, Gaskey & Olds PC

(57) ABSTRACT

A tub surround includes a retainer assembly which is mounted within an outer band section to receive an inner band section to connect the surround sections. The retainer assembly also permits the surround to be arranged in a packaged arrangement, which is conducive to efficient storage and shipment.

9 Claims, 4 Drawing Sheets

INTERFACE STRUCTURE FOR A SHOWER SURROUND

BACKGROUND OF THE INVENTION

The present invention relates to an interface between panels of a molded plastic shower surround.

Tub and shower surrounds are positioned within a recess built around a bathtub or shower surround. Conventional modular tub/shower units often include a base portion at the bottom and two or more wall portions. The whole structure is mounted adjacent a wall or corner to form a waterproof surround. The fully enclosed waterproof structure prevents the escape of water into the wall cavity despite the shower spraying water onto the surrounding walls.

One issue that arises with products of this type is that of forming a suitable joint between the surround portions. Various styles of joint have been used, each of which providing particular tradeoffs in complexity, aesthetics, and sealing ability.

Accordingly, it is desirable to provide a waterproof joint between wall portions of a molded plastic shower surround that is uncomplicated and aesthetically pleasing while assuring an effective watertight seal.

SUMMARY OF THE INVENTION

The tub surround according to the present invention provides a retainer assembly which is mounted within an outer band section to receive an inner band section to connect the surround sections. The outer band section supports the retainer assembly such that the inner band section "clips" into the retainer assembly.

The retainer assembly also permits the surround to be arranged in a packaged arrangement which is conducive to efficient storage and shipment.

The present invention therefore provides a waterproof joint between wall portions of a molded plastic shower surround which is uncomplicated and aesthetically pleasing while assuring an effective watertight seal.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
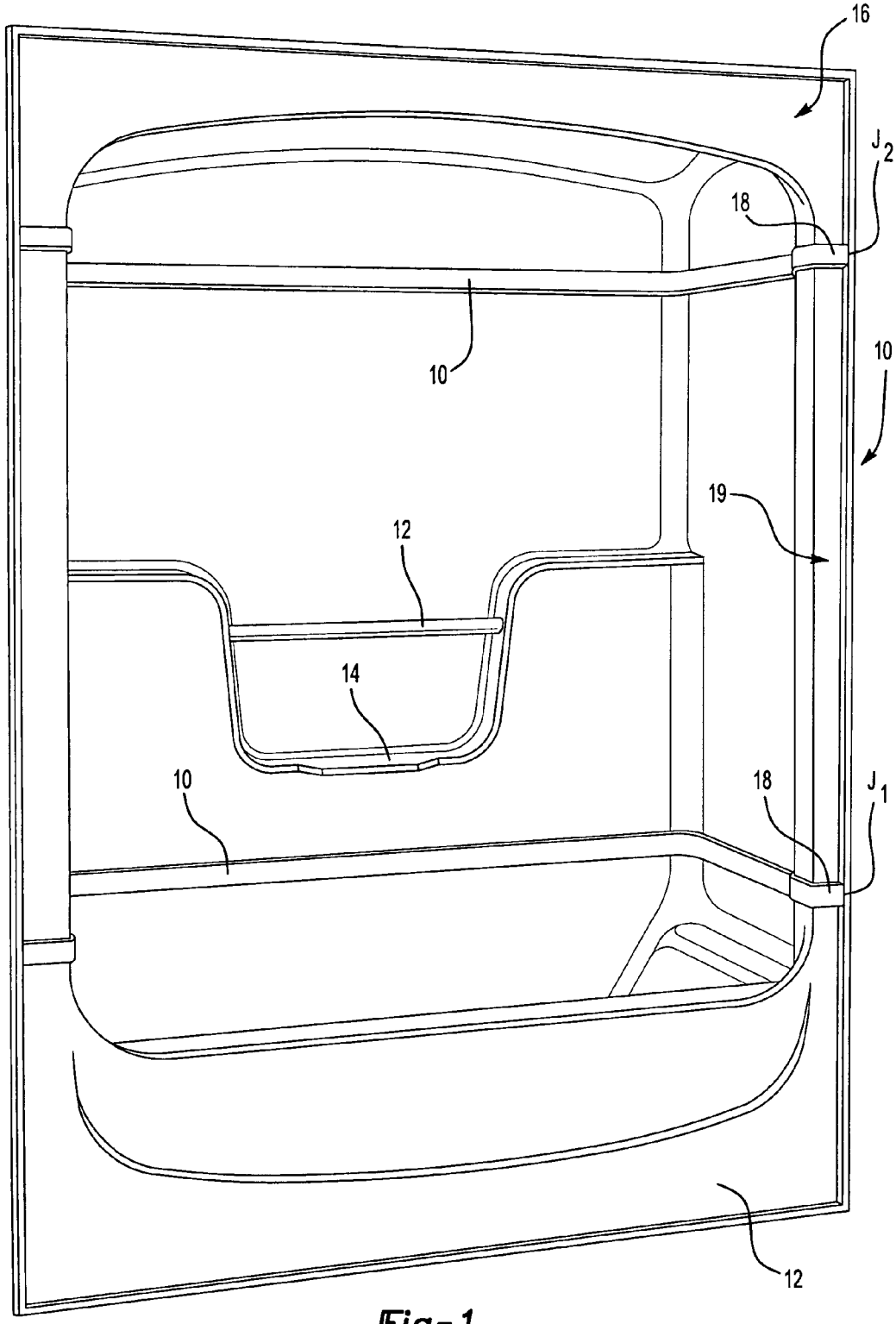
FIG. 1 is a general front view a molded shower surround according to the present invention.

FIG. 1 illustrates a general exploded view of a molded shower surround 10. The surround 10 preferably includes a tub section 12, a mid section 14 and a canopy section 16. It should be understood that the term "tub" is not limited to bath tubs only and that relatively shallow shower bases and the like will also benefit from the present invention.

The surround 10 is typically formed from an initially uniform thickness acrylic sheet on a vacuum-forming mold. The sections are then separated from the single integrally molded component. The width is that desired for the finished assembly, the height is greater than that desired in the finished assembly by approximately the amount of joint J overlap in the assembled product.

A raised band 18 extends substantially horizontally across the mold between the tub section 12 and the mid section 14, and the mid section and the canopy section 16. That is, the position of the bands 18 will correspond to the desired positions for joints between the surround sections. As will be understood, the invention does not require the provision of more than one such band and joint. However, the provision of two provides sections of smaller dimensions for more easy access to the doors and passages of a house and also the provision of two joints instead of one is thought to provide a more balanced and pleasing appearance. It is also noted that it is within the scope of the invention to provide that the bands and joints may be of other configurations. Structural and ornamental use of horizontal bands and joints is preferred, and horizontal joints may best utilize the advantages of the invention.

Figure 2A:
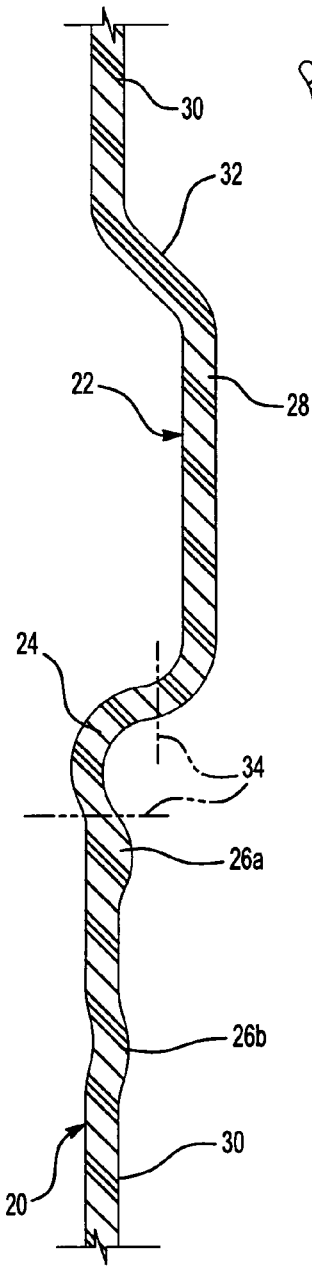
FIG. 2A is an expanded sectional view of a joint section of the molded shower surround prior to separation.

Referring to FIG. 2A, a cross section of the band 18 is illustrated in the original blank prior to separation of the surround sections. Each band 18 includes an inner band section 20, an outer band section 22 and a scrap section 24. The inner band section 20 preferably includes a pair of ribs 26*a*, 26*b*. The ribs 26*a*, 26*b* are raised areas formed in the surround surface 30 and may take various shapes. The outer band section 22 includes a stepped band section 28 which is generally displaced from a surround surface 30 by an angled band section 32. That is, the outer band section 22 is raised from what would otherwise be the continuous surround surface 30 which defines the inner surface of the surround 10. The scrap section 24 is defined by cuts 34 which separate the surround 10 into the sections 12, 14, 16 (FIG. 1).

Figure 2B:
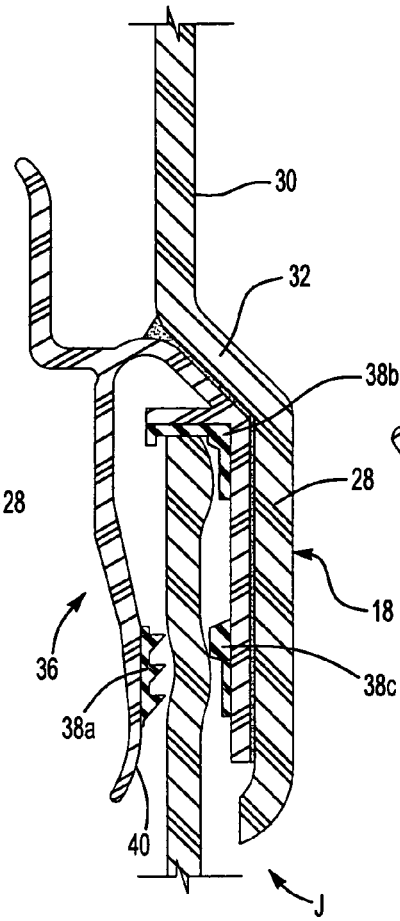
FIG. 2B is an expanded sectional view of a joint section of the molded shower surround in an assembled condition after separation.
Figure 3:
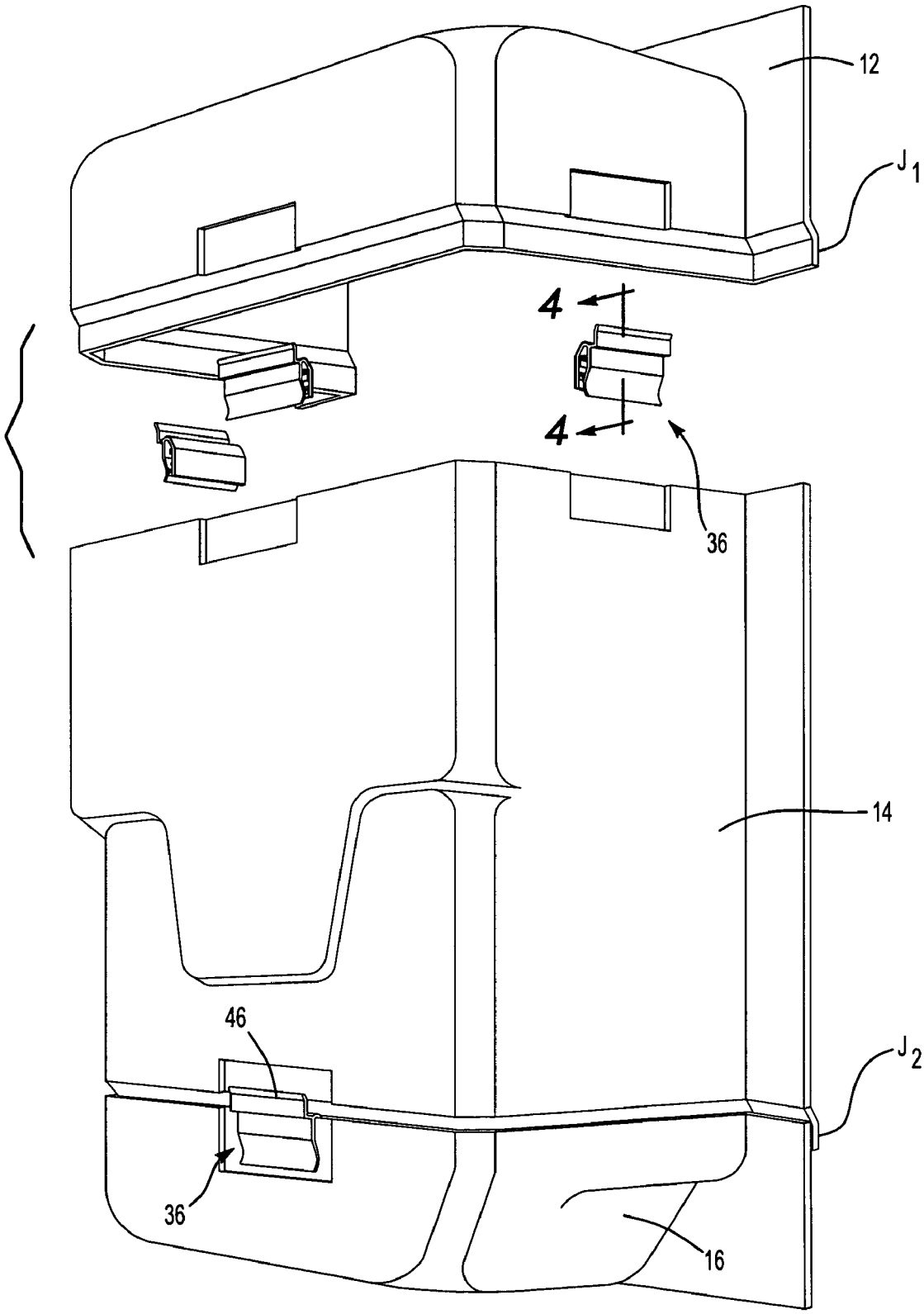
FIG. 3 is an expanded sectional view of a retainer assembly portion taken along the line 3-3 in FIG. 4.

Referring to FIG. 2B, after the cut, a retainer assembly 36 is mounted within the outer band section 22 through an adhesive or the like. The retainer 36 receives the inner band section 20 therein to connect the sections 12, 14, 16 at joints J1, J2 to form the surround (also illustrated in FIG. 3) during installation. In other words, the retainer 36 is mounted to the outer band section 22 which "clips" onto the inner band section 20. Preferably, resilient seals 38*a*, 38*b*, 38*c* are mounted within a retainer frame 40 to form the retainer assembly 36. The seals 38*a*, 38*b*, 38*c* seal the inner surface of the surround 10 from moisture and also minimize noise which may occur should one section 12, 14, 16 be relatively displaced to another section 12, 14, 16 such as by bather within the surround 10.

Figure 4:
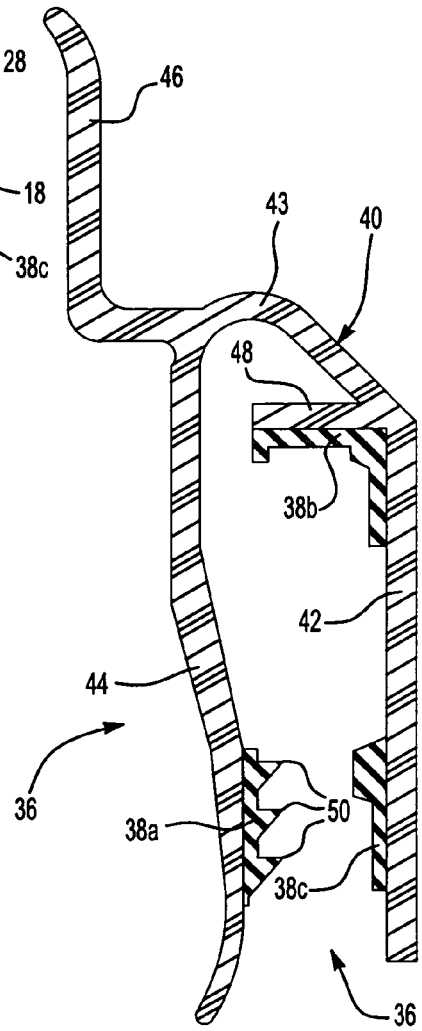
FIG. 4 is a rear perspective view a molded shower surround in an assembled condition.

Referring to FIG. 4, the retainer assembly 36 includes the resilient seals 38*a*, 38*b*, 38*c* mounted within retainer frame 40. The resilient seals 38*a*, 38*b*, 38*c* are preferably manufactured of SANTOPRENE rubber and the retainer frame 40 is preferably a molded plastic material, however, other materials will likewise benefit.

The frame 40 generally includes a pair of opposed frame arms 42, 44 which form a generally U-shape. The arm 42 is preferably shaped to be received directly adjacent the outer band section 22 and the angled band section 32. A retainer frame arm 46 extends generally opposite the opposed arms 42, 44. The retainer arm 46 is generally L-shaped and extends from an arcuate frame portion 43 which connects opposed arms 42, 44. A stop 48 extends from the arm 42. The stop 48 is preferably located between and transverse the arms 42, 44.

Resilient seals 38*a*, 38*b*, 38*c* are located within the arms 42, 44. Seal 38*a* extends from arm 44 and includes a multiple of wipers 50 which extend toward arcuate frame portion 43. The wipers 50 assist in receiving the inner band section 20 and providing a seal therewith when the surround 10 is assembled (FIG. 4). Although it is not thought necessary in most instances, a gasket or sealing compound rubber may be provided for each joint J.

Figure 5:
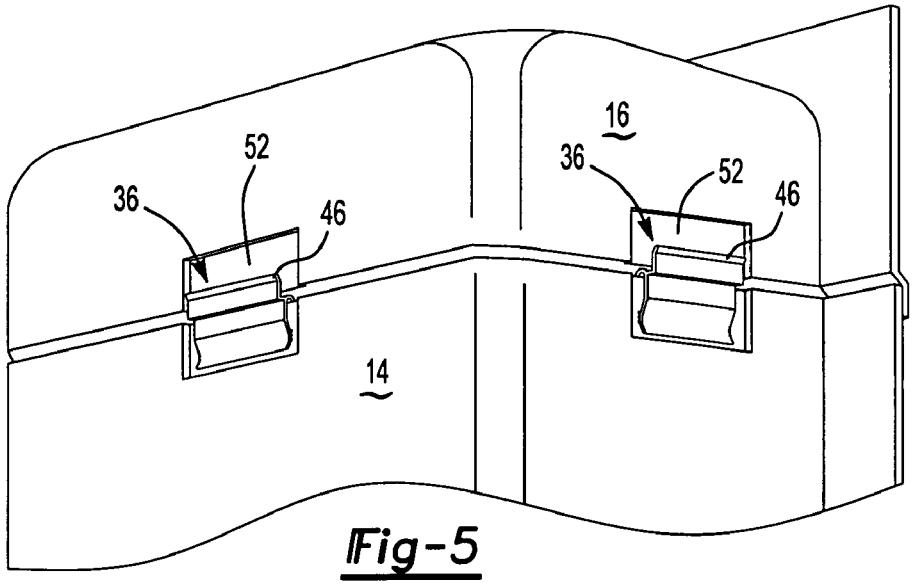
FIG. 5 is an expanded rear view of an upper portion of the shower surround.

Referring to FIG. 5, the retainer assembly 36 are preferably located within recesses 52 formed in the section 12, 14, 16 where the fiberglass and if necessary some of the acrylic is removed from the outward side of the upper section just above the cut 34. The material is removed by grinding, routing, or the like, such that each recess 53 is shaped so that in the overlapped position with the overlapping sections pressed against each other the vertical extents of the upper section above and of the lower section below the bands are approximately co-planar. It should be understood that although the retainer assemblies 36 are disclosed in the illustrated embodiment as essentially straight, other shapes will like wise benefit from the present invention.

Figure 6:
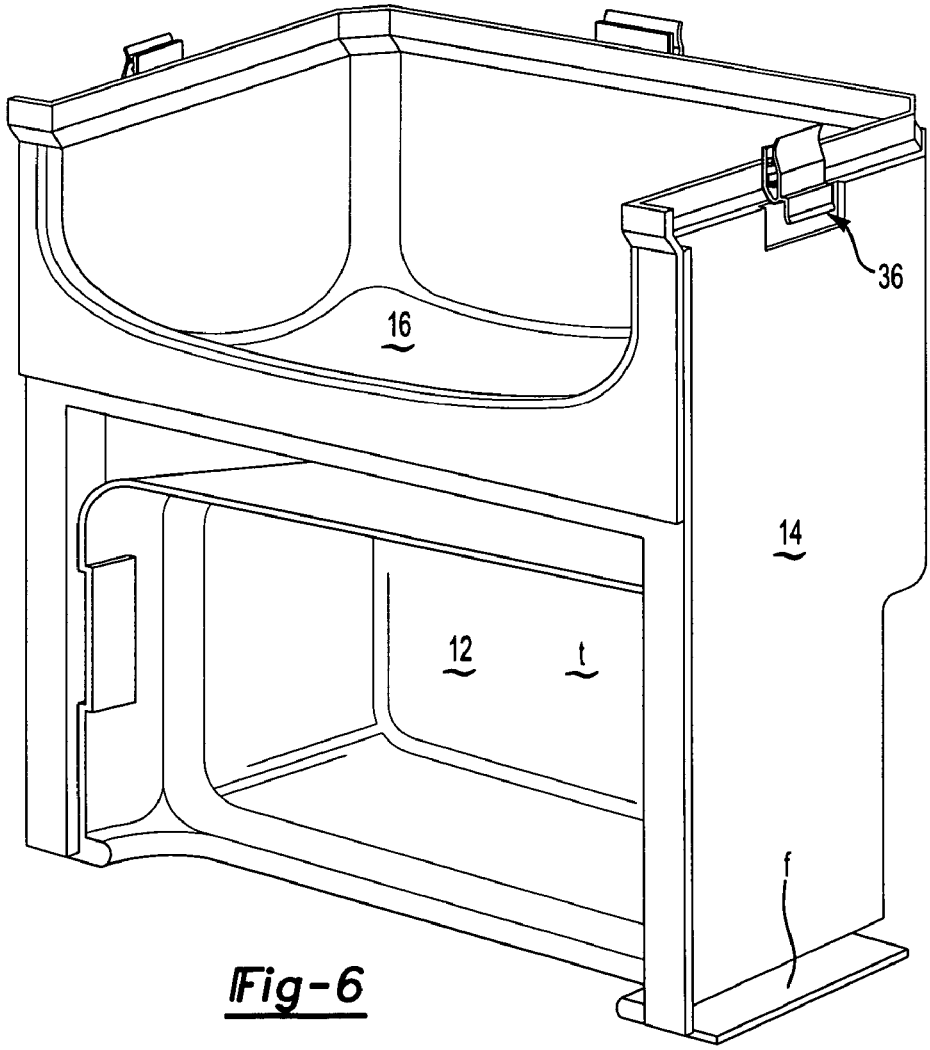
FIG. 6 is a perspective view a molded shower surround in a packaged arrangement condition.

Referring to FIG. 6, the surround 10 is arranged in a packaged arrangement which is conducive to efficient storage and shipment. In the packaged arrangement, the tub section 12 is placed with the apron face down such that the interior of the tub t is outwardly arranged. The depth is approximately 24", which readily permits transport through doorways and the like. Next, the mid section 14 is arranged around the tub section 12 and sits atop the tub section flange f. Finally the canopy section 16 is inverted into the mid section 14 such that the retainer arm 46 faces downward and toward the tub section 12. The retainer arm 46 engages the outer perimeter of the mid section 14 to provide a relatively rigid cubical-shaped unit.

It should be understood that relative positional terms such as "forward," "aft," "upper," "lower," "above," "below," and the like are with reference to the normal operational attitude of the surround and should not be considered otherwise limiting.

It should be understood that although a particular component arrangement is disclosed in the illustrated embodiment, other arrangements will benefit from the instant invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A shower surround comprising:

a first surround section comprising an inner band section;

a second surround section comprising an outer band section; and a retainer assembly mounted to said outer band section, said retainer assembly comprising a first frame arm opposed to a second frame arm and a stop which extends from one of said first frame arm and said second frame arm, said inner band section receivable against said stop and between said first frame arm and said second frame arm, wherein said inner band comprises a rib which extends therefrom, and a first seal mounted to said first frame arm, wherein said first seal is engageable with said rib.

2. The shower surround as recited in claim 1, wherein said outer band comprises a stepped band section displaced from a surround surface.

3. The shower surround as recited in claim 1, further comprising a second seal mounted to said second frame arm, said second seat engageable with said inner band section opposite said rib.

4. The shower surround as recited in claim 3, further comprising a multiple of wipers which extend from said second seal.

5. A shower surround comprising:

a first surround section comprising an inner band section, said inner band comprises a rib which extends therefrom;

a second surround section comprising an outer band section;

a retainer assembly mounted to said outer band section, said retainer assembly comprising a first frame arm opposed to a second frame arm and a stop which extends substantially between said first frame arm and said second frame arm, said inner band section receivable against said stop and between said first frame arm and said second frame arm; and a first seal mounted to said first frame arm, said first seal engageable with said rib.

6. A shower surround comprising:

a first surround section comprising an inner band section;

a second surround section comprising an outer band section;

a retainer assembly mounted to said outer band section, said retainer assembly comprising a first frame arm opposed to a second frame arm and a stop which extends from one of said first frame arm and said second frame arm, said inner band section receivable against said stop and between said first frame arm and said second frame arm; and a multitude of seals mounted within said retainer assembly to receive said inner band.

7. The shower surround as recited in claim 1, further comprising a seal mounted to said stop to receive an end segment of said first inner band.

8. The shower surround as recited in claim 7, wherein said seal is generally L-shaped.

9. The shower surround as recited in claim 7, wherein said seal includes a first surface adjacent said stop and a second surface adjacent at least one of said first frame arm and said second frame arm.

* * * * *